US010065772B2

(12) United States Patent
Schneider

(10) Patent No.: US 10,065,772 B2
(45) Date of Patent: Sep. 4, 2018

(54) CONTAINER COMPRISING TWO SEALING SEGMENTS

(71) Applicant: SANNER GmbH, Bensheim (DE)

(72) Inventor: Matthias Schneider, Heidesheim (DE)

(73) Assignee: Sanner GmbH, Bensheim (DE)

( * ) Notice: Subject to any disclaimer, the term of this patent is extended or adjusted under 35 U.S.C. 154(b) by 0 days.

(21) Appl. No.: 14/697,978

(22) Filed: Apr. 28, 2015

(65) Prior Publication Data

US 2016/0318677 A1 Nov. 3, 2016

(51) Int. Cl.

*B65D 53/02* (2006.01)
*B65D 43/16* (2006.01)
*B65D 43/02* (2006.01)

(52) U.S. Cl.

CPC ..... *B65D 43/162* (2013.01); *B65D 43/0212* (2013.01); *B65D 2543/0062* (2013.01); *B65D 2543/0074* (2013.01); *B65D 2543/00092* (2013.01); *B65D 2543/0099* (2013.01); *B65D 2543/00296* (2013.01); *B65D 2543/00537* (2013.01); *B65D 2543/00694* (2013.01); *B65D 2543/00796* (2013.01); *B65D 2543/00842* (2013.01)

(58) Field of Classification Search

CPC ..... B65D 53/02; B65D 43/166
USPC ..... 220/839
See application file for complete search history.

(56) References Cited

U.S. PATENT DOCUMENTS 1,633,197 A 6/1927 Snyder
2,894,654 A 7/1959 Lohrer
2,990,077 A 6/1961 Van Baarn
3,113,693 A 12/1963 Stull
3,145,872 A 8/1964 Hayes
3,441,161 A 4/1969 Van Baarn
3,462,048 A 8/1969 Henchert
3,872,993 A 3/1975 Aichinger
4,043,475 A 8/1977 Wheeler
4,783,056 A 11/1988 Abrams
5,312,011 A 5/1994 Fischer
5,489,036 A * 2/1996 Arkins ..... B65D 41/0421 215/343

(Continued)

FOREIGN PATENT DOCUMENTS

GB 2151591 A 7/1985
JP 2004161323 6/2004

(Continued)

*Primary Examiner* — Jeffrey Allen

(74) *Attorney, Agent, or Firm* — Dean W. Amburn; Giroux Amburn PC

(57) ABSTRACT

The invention relates to a container having a container body with a container opening and a container closure. A hinge connects the container closure to the container body. The container body includes a container wall, which forms a container space. The container opening is surrounded by a rim. The container closure is a snap on closure movable between an open position and a closed position. The container closure has a base with a skirt. The container closure has a first sealing segment and a second sealing segment, wherein the first sealing segment is arranged on an inner side of the skirt and the second sealing segment is arranged on the base. In the closed position, the first sealing segment rests against an outer side of the rim and the second sealing segment rests against a front surface of the rim.

17 Claims, 10 Drawing Sheets

(56) References Cited

U.S. PATENT DOCUMENTS

| | | | | |
|---|---|---|---|---|
| 5,667,094 | A * | 9/1997 | Rapchak | B65D 43/162 215/306 |
| 6,299,033 | B1 * | 10/2001 | VerWeyst | B65D 43/021 222/480 |
| 7,472,797 | B2 * | 1/2009 | Ostrowski | A61J 9/00 215/230 |
| 2008/0035658 | A1 | 2/2008 | Caulfield | |
| 2011/0000930 | A1 * | 1/2011 | Logel | B65D 43/162 220/849 |

FOREIGN PATENT DOCUMENTS

| | | |
|---|---|---|
| WO | 96/33108 | 10/1996 |
| WO | 2005/074571 | 8/2005 |

* cited by examiner

CONTAINER COMPRISING TWO SEALING SEGMENTS

FIELD OF THE INVENTION

The present invention relates to a molded plastic container with a container body and a snap on container closure, and more particularly concerns the sealing or seals between the container body and the container closure.

BACKGROUND OF THE INVENTION

The present invention relates to a container comprising a container body, which comprises a container opening, and a container closure for the container opening, wherein the container body and the container closure are embodied as a one-piece injection molded part comprising a hinge, which movably connects the container closure to the container body, wherein the container body comprises a container wall, which forms a container space, wherein the container opening is surrounded by a rim, wherein the container closure is designed as a snap on closure and can be moved between an open position and a closed position, wherein the container closure comprises a base, at which a skirt is arranged, wherein the container closure comprises a first sealing segment and a second sealing segment, wherein the first sealing segment is arranged on an inner side of the skirt and the second sealing segment is arranged on the base, wherein, in the closed position, the first sealing segment rests against an outer side of the rim to form a first seal.

Such a container is known from U.S. Pat. No. 4,783,056. The known container comprises two sealing segments, one of which rests against the outer side of the rim in the closed position and the other one of which rests against the inner side of the rim. A further container comprising a similar shape is known from WO 96/33108.

U.S. Pat. No. 3,441,161 describes a closure for a bottle. The closure is thereby embodied as a separate part. It comprises a segment, which rests against the front surface of the bottle.

U.S. Pat. No. 6,299,033 B1 describes a closure for a container. The closure comprises flaps, which can be opened and closed.

SUMMARY OF THE INVENTION

It is one object of the invention to specify a container, which seals reliably and can be manufactured and operated easily.

This task is solved by means of the features of claim 1. Accordingly, provision is made in the case of the above-mentioned container that, in the closed position, the second sealing segment rests against a front surface of the rim, so as to form a second seal. On the one hand, a reliable seal is attained in this manner. In addition, the container can be produced easily and cost-efficiently by means of the injection molding process. Container closure and container body can thereby be produced together in one piece by means of the injection molding process. A separate production of the container closure and an assembly to the container body are thus not required. In addition, the container according to the invention makes it possible to completely use the container space as a reliable sealing is attained, without provision having to be made for sealing elements, which project into the container space. Accordingly, the container can have smaller dimensions with the same filling volume. This also contributes to material savings. Thus, costs can be lowered and the waste volume can also be reduced. In addition, the smaller dimensions also contribute to a reduction of the transport costs. The container is suitable in particular for pharmaceutical products, such as tablets, which can be arranged in the container space. The container can preferably be a vial.

An advantageous embodiment of the invention provides for the skirt to comprise an area, which projects inwards in radial direction and for the rim to comprise an area, which projects outwards in radial direction and, in the closed position, for the area of the skirt, which projects inwards, to lock in place with the area of the rim, which projects outwards so as to fix the container closure in the closed position. This contributes in particular to a reliable seal and to an easy handling.

A particularly advantageous embodiment provides for the first sealing segment and the area, which projects outwards, to be embodied such that, in the closed position, the container closure is pulled towards the container body.

An improvement is furthermore achieved in that the area, which projects inwards, comprises a peak, that a first surface is connected to a first side of the peak, which is located closer to the base, and that a second surface is connected to a second side of the peak, which is located further away from the base, and that the first and the second surfaces are inclined relative to a longitudinal container axis of the container body. Preferably, the first and second surfaces are inclined in opposite directions. In addition to a reliable seal, it can also be attained that the container closure is automatically being pulled into the closed position as soon as the peak was moved across the area, which projects outwards. A contact pressure, which acts so as to remain in the closed position and which improves the sealing effect, can be generated between the second sealing segment and the front surface. The peak can in particular be embodied circumferentially in a ring-shaped manner. Preferably, an angle of inclination between the first surface and the longitudinal container axis is between 175° and 140°, particularly preferably between 170° and 160°. In addition, an angle of inclination between the second surface and the longitudinal container axis is preferably between 5° and 50°, particularly preferably between 10° and 30°. The inner side of the skirt can thereby in particular comprise a shape, which has a substantially triangular cross section.

According to another advantageous embodiment of the invention, the first surface comprises a cone segment-shaped area and/or the second surface comprises a cone segment-shaped area.

A further improvement is attained in that the peak is formed by means of a radius-shaped area, which connects the first and the second surface.

According to the invention, it is furthermore preferred for the rim to comprise a cone segment-shaped sealing surface, against which the first sealing segment rests in the closed position. The cone segment-shaped area can in particular be formed by means of a segment of the area of the rim, which projects outwards.

A preferred embodiment of the invention provides for no seal to be provided, which rests against an inner side of the rim.

An advantageous embodiment provides for the base of the container closure and the container body to be injection molded from the same plastic material. A reliable seal can be attained in this manner, wherein the production can take please easily and reliably.

It is furthermore advantageous that the skirt comprises a first skirt height, that the skirt comprises a recess in the area of the hinge and that the skirt comprises a second lower height in the area of the recess. The hinge can be articulated in the segment with the second skirt height. This facilitates in particular the closing of the container closure.

Another advantage is achieved in that the second sealing segment to be arranged in a depression and/or that a peak of the second sealing segment does not project beyond a plane, which is formed by the inner side of the base. This design also contributes to a reliable sealing. In addition, the full wall thickness can thereby mostly be maintained in the area of the base, which counteracts an undesired diffusion of moisture. Preferably, a curved segment comprising a radius of between 0.2 mm and 0.75 mm (0.0079 in and 0.0295 in) is arranged on the peak. This contributes to a reliable sealing and operability.

A further preferred embodiment of the invention provides for the base to comprise, on its inner side, a first groove towards the one side of the second sealing segment and a second groove towards another side of the second sealing segment. Preferably, the grooves are embodied circumferentially. This contributes to a reliable seal.

A further advantageous embodiment provides for a first boundary surface to be connected to the peak of the second sealing segment on a first side and for a second boundary surface to be connected to the peak on a second side and for the first and the second boundary surfaces to be inclined relative to a longitudinal container axis of the container body. The first and the second boundary surface are thereby in particular inclined in opposite directions. Preferably, the angle of inclination between the first boundary surface and the longitudinal container axis is between 10° and 60°, preferably between 30° and 50°. The angle of inclination between the second boundary surface and the longitudinal container axis is preferably also between 10° and 60°, particularly preferably between 30° and 50°. In particular, the second sealing segment can substantially be triangular-shaped in cross section.

A further improvement of the seal is attained in that the first sealing segment rests against the rim under pretension such that, in the closed position, the skirt is deformed elastically outwards in radial direction. For this purpose, a diameter on an inner side of the skirt in the open position can in particular be smaller than a diameter on an outer side of the rim, if the container closure is in the open position. Preferably, the first sealing segment can additionally be embodied as a cone seal.

Advantageously, provision can furthermore be made for the skirt and the base to be embodied such that the second sealing segment is pretensioned against the front surface by means of the deformation of the skirt in the closed position. This also contributes to a reliable seal.

An advantageous embodiment provides for the first sealing segment and the second sealing segment to consist of the same plastic material as the base of the container closure. A reliable seal can be attained in this manner. In addition, the production is easy and cost-efficient.

Another advantageous embodiment provides for the first sealing segment and/or the second sealing segment to consist of a different material than the base of the container closure. Thus, for example, a softer material can be used for the first and/or second sealing segment e.g. in order to provide even better sealing. Such a container can be produced, for example, in a two component injection molding process.

It is advantageous for the hinge to be embodied as integral hinge. In particular, the hinge can have a butterfly shape. Preferably, the container closure is embodied as flip-top closure.

A further improvement is attained, when provision is made at the skirt for an actuating segment, which is arranged on a right angle to the skirt and via which the container closure can be moved into the open position. The container closure can be opened or closed in this manner, e.g. by means of the finger or automatically in response to filling.

An advantageous embodiment provides for the skirt to be arranged substantially vertically to the base.

An advantageous embodiment provides for the skirt to be embodied circumferentially.

Preferably, the base is substantially flat.

Advantageously, the rim comprises a groove on its outer side, which extends in peripheral direction. The groove is preferably circumferential. The area, which projects outwards, can be arranged between the groove and the front surface.

An advantageous embodiment provides for the container body to comprise a segment below the rim, which faces outwards from the container wall. Preferably, the segment, which faces outwards, is embodied circumferentially. It can in particular be arranged vertically to the longitudinal container axis. The hinge can be arranged on the segment, which faces outwards.

According to the invention, the container body is tubular. Preferably, the container body is cylindrical. Furthermore, preferably the container closure is cylindrical.

A preferred embodiment provides for the container wall to comprise a side wall and a bottom, wherein the rim is arranged in the extension of the side wall.

It is furthermore preferred for the front surface to be flat. Preferably, the front surface is arranged in a plane surface, which runs at a right angle to the longitudinal container axis.

In a preferred manner, the container is embodied as a tablet packaging as tablets are in particular accommodated in the container space.

A preferred embodiment provides for the container body to comprise an inner diameter across its height, which increases towards the container opening. Preferably, the inner diameter of the container opening is larger than the inner diameter in the container body. This embodiment enables a simple handling. Further, it enables the easy production by means of the injection molding process as the injection-molded core, which forms the interior of the container body, can be extracted through the container opening while demolding the container.

A further preferred embodiment provides for a drying agent, such as, e.g. silica gel, to be arranged in the container, so as to keep the container space dry. The drying agent can be provided in a drying agent chamber, which is arranged on the container bottom, e.g. the drying agent can also be arranged distributed in a moisture-permeable plastic material (drying agent compound). The plastic material with the drying agent can be arranged at the inner side of the container wall for example.

Further objects, features, advantages and possible uses of the instant invention follow from the subsequent description of exemplary embodiments by means of the drawing. All of the features, which are described and/or depicted, either alone or in any sensible combination, thereby form the subject matter of the invention, even independent from the summary in the individual claims or the dependencies thereof.

DETAILED DESCRIPTION OF THE PREFERRED EMBODIMENTS

Figure 1A:
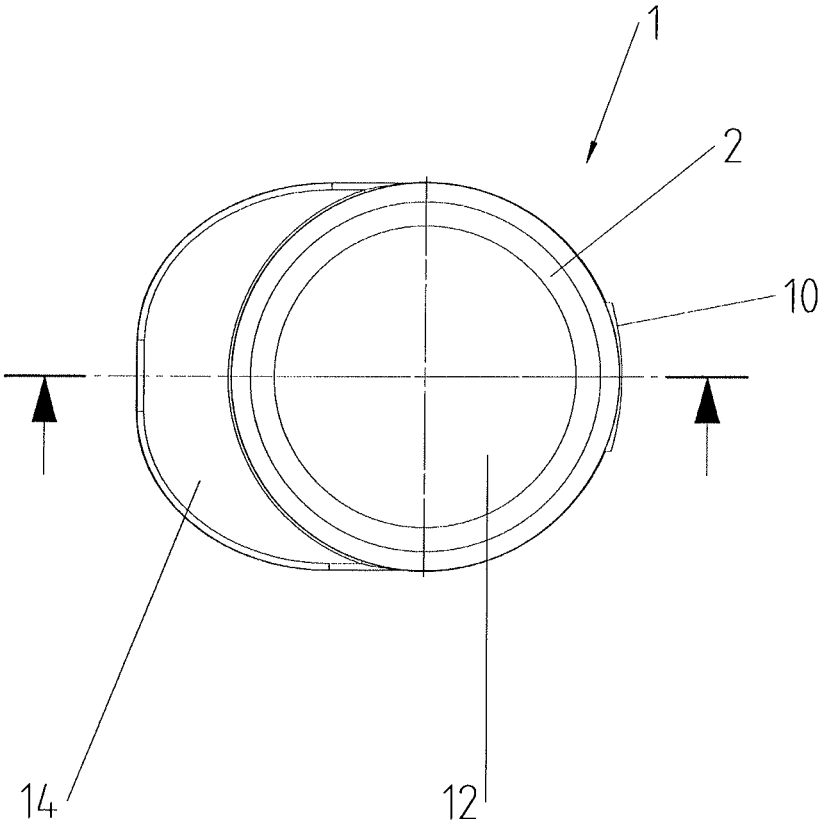
FIG. 1*a* shows a top view onto a container according to the invention comprising the container closure in the closed position.
Figure 1B:
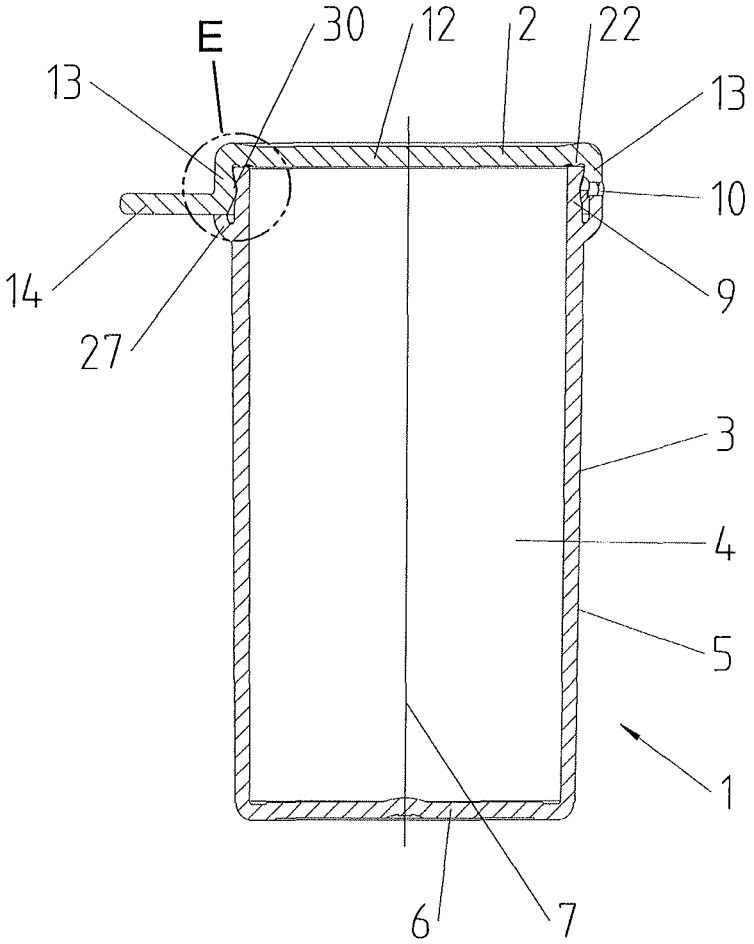
FIG. 1*b* shows a longitudinal section through the container from FIG. 1*a;*
Figure 1C:
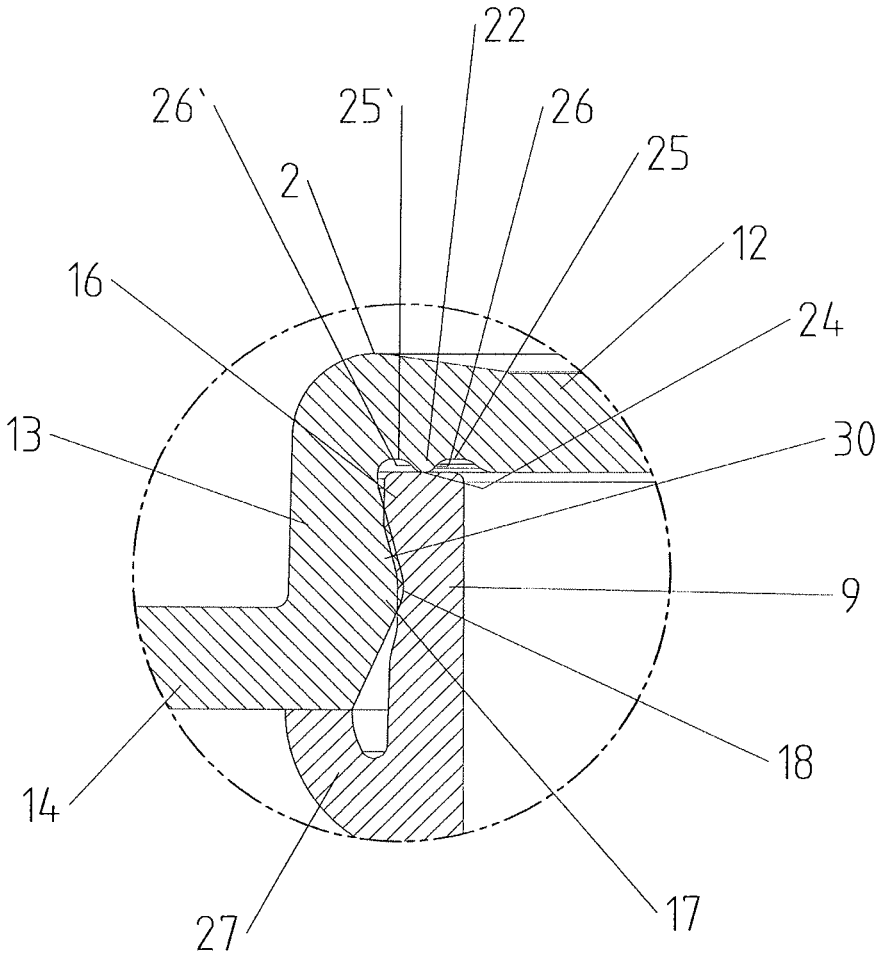
FIG. 1*c* shows the enlarged detail E of the container from FIG. 1*b;*
Figure 2A:
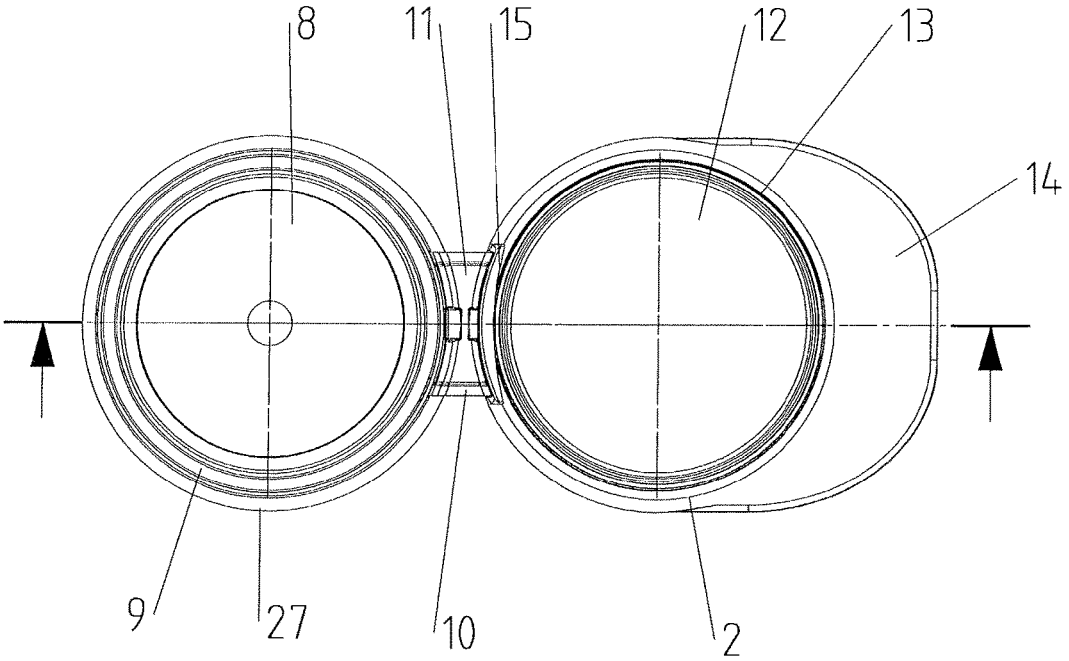
FIG. 2*a* shows a top view onto the container from FIG. 1*a* comprising the container closure in the open position.
Figure 2B:
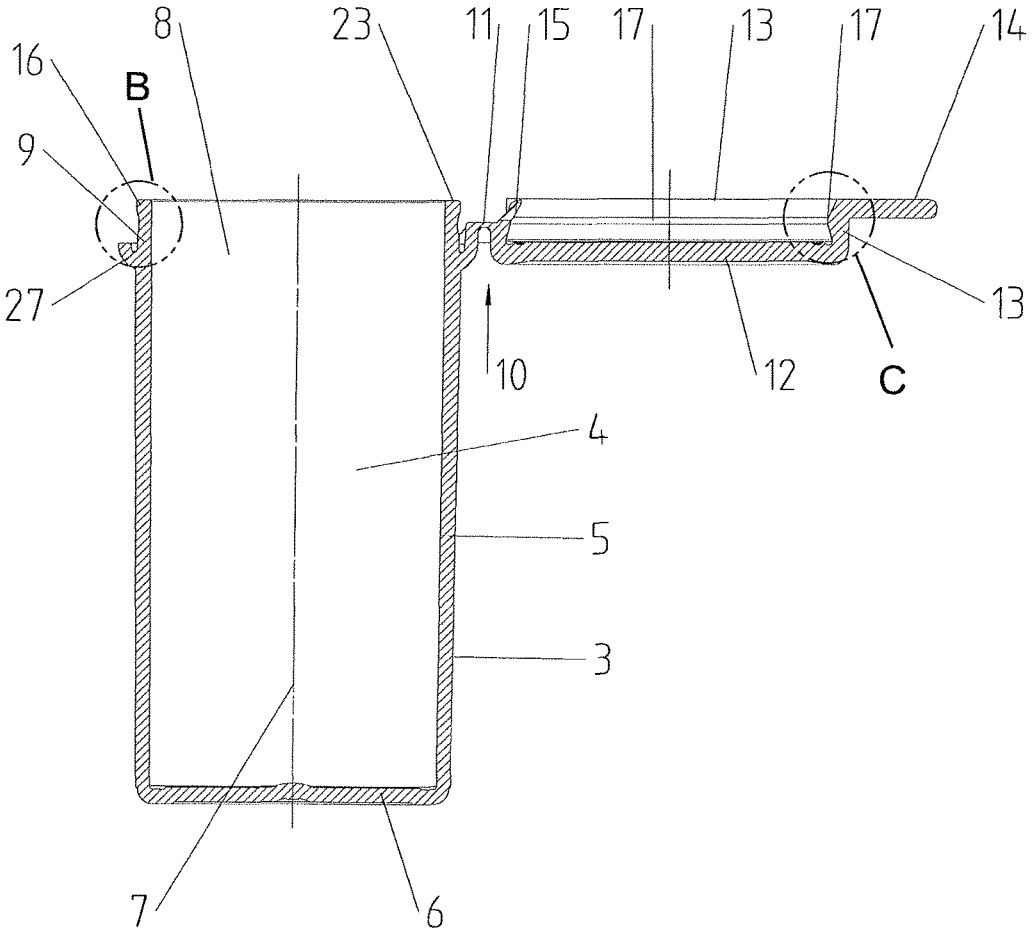
FIG. 2*b* shows a longitudinal section through the container from FIG. 2*a;*
Figure 2C:
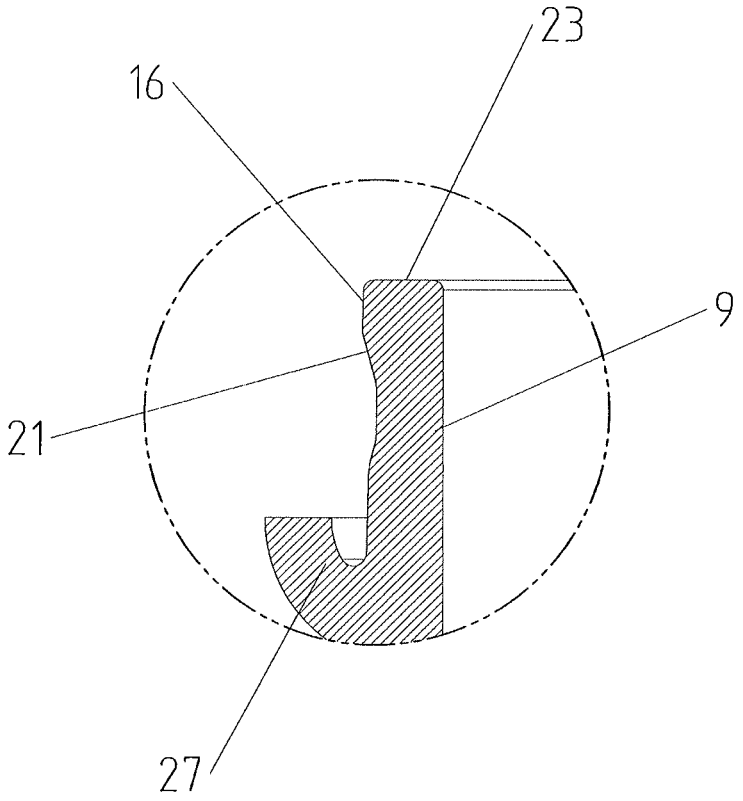
FIG. 2*c* shows the enlarged detail B of the container from FIG. 2*b;*
Figure 2D:
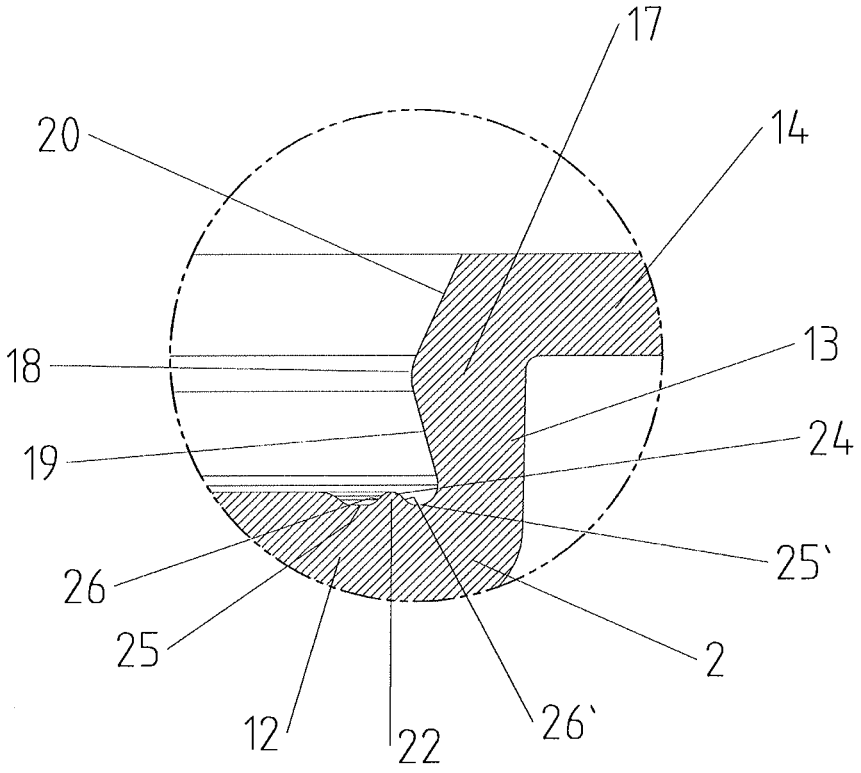
FIG. 2*d* shows the enlarged detail C of the container from FIG. 2*b;*
Figure 2E:
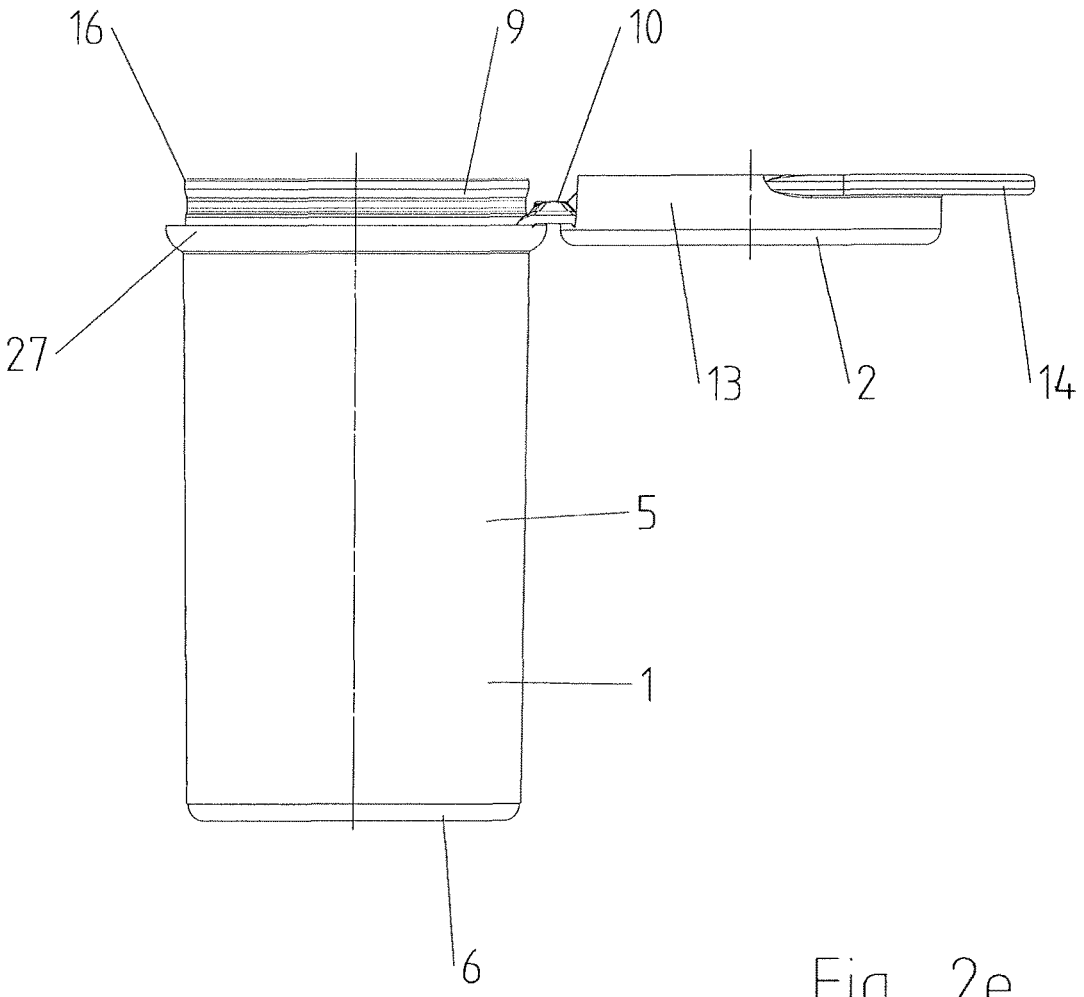
FIG. 2*e* shows a side view of the container from FIG. 2*a;*
Figure 2F:
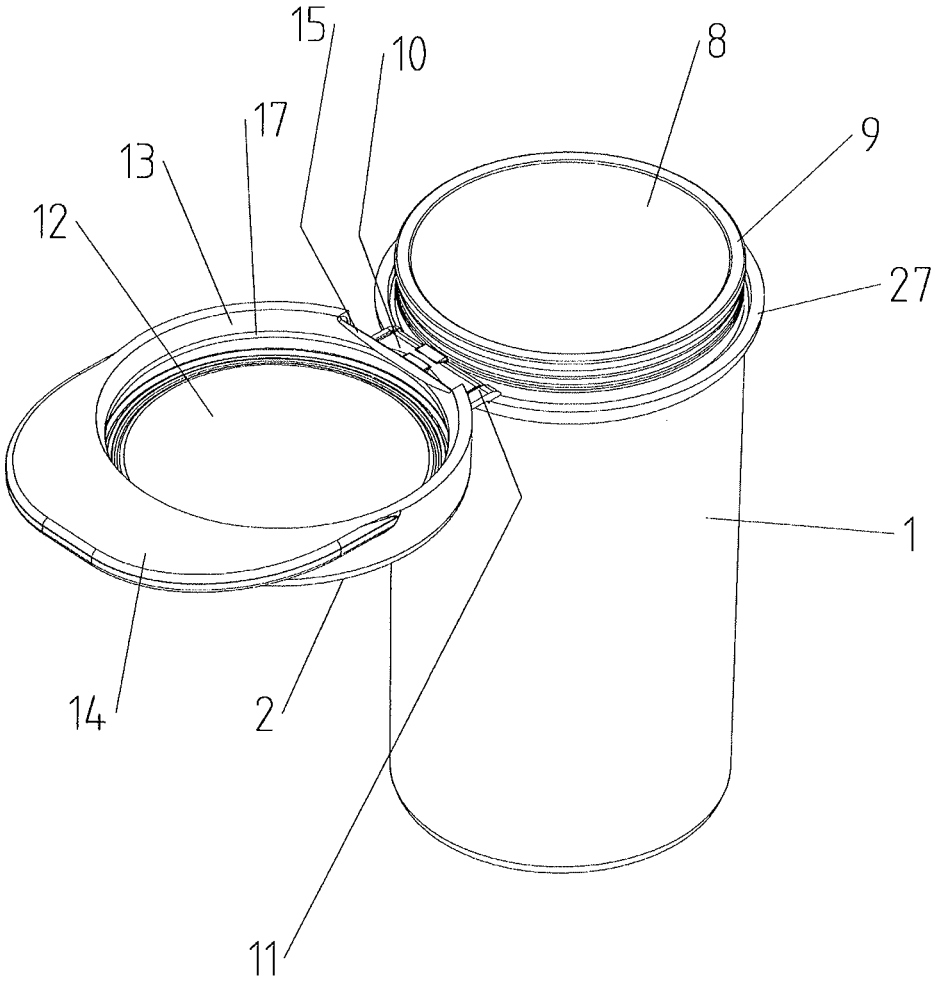
FIG. 2*f* shows a perspective illustration of the container from FIG. 2*a;*

A first embodiment of the container is illustrated in FIGS. 1*a* to 2*f*. The container comprises a container body 1 and a container closure 2.

In the illustrated exemplary embodiment, the container body 1 is tubular. It comprises a container wall 3, which forms a container space 4. Goods to be packaged, e.g. pharmaceutical tablets (not illustrated), can be arranged in the container space 4. The wall 3 forms a side wall 5 and a bottom 6. In the illustrated exemplary embodiment, the container body 1 has a substantially cylindrical shape comprising a circular cross section (see, e.g., FIG. 1*b*). The container body 1 thereby has an elongate shape. A longitudinal container axis 7 of the container body 1 is specified in FIGS. 1*b* and 2*b*.

The container body 1 comprises a container opening 8. The latter is surrounded by a rim 9 (see in particular FIGS. 2*a* and 2*b*). The rim 9 comprises an inner side and an outer side. The inner side and the outer side are connected by an end face of the rim 9, which forms the front surface 23. In the case of the illustrated container, the rim 9 is arranged in the extension of the side wall 5. The inner diameter of the container body 1 in the area of the rim 9 is substantially the same as the inner diameter of the container body 1 in the area of the side wall 5. Accordingly, the container opening 8 extends across the entire container cross section. The inner diameter in the area of the rim 9 can be slightly larger than the inner diameter in the area of the container body 1 in order to facilitate the demolding process.

The container body 1 comprises a hinge 10, via which the container closure 2 is movably connected to the container body 1. The container closure 2 can thus be moved repeatedly between the closed position illustrated in FIGS. 1*a* to 1*c* and the open position illustrated in FIGS. 2*a* to 2*f*. The hinge 10 is designed as an integral hinge. The hinge 10 comprises a segment with a reduced material thickness 11. The hinge 10 has a butterfly shape (see, e.g. FIG. 2*a*). Thus, the plastic material can be moved easily when opening and closing the container closure 2.

In the closed position, the container closure 2 closes the container opening 8. The container closure 2 thereby extends over the rim 9. In the illustrated exemplary embodiment, the container closure 2 comprises a base 12 and a skirt 13 arranged thereon. The base is embodied so as to be substantially flat. The skirt 13 extends substantially vertically to the base 12. Provision is made at the skirt 13 for an actuating segment 14, which is arranged on a right angle thereto. The actuating segment 14 is arranged on the side located opposite the hinge 10. In a middle region, the actuating segment 14 comprises a straight contour, which merges into a curved contour on both sides.

The skirt 13 is arranged on the outer rim of the base 12. The skirt 13 is embodied circumferentially. The height of the skirt, measured from the inner side of the base 12, is between 10% and 20% of the inner diameter of the container closure 2. The skirt 13 comprises a first segment comprising a first skirt height. In the area of the hinge 10, the skirt 13 is provided with a recess 15 and comprises a second, smaller skirt height in this area. The recess 15 thereby facilitates the closing of the container closure 2.

The container closure 2 is designed as a snap on closure. In the closed position, a form fit, which holds the container closure 2 in the closed position, is attained between container closure 2 and container body 1. For this purpose, the rim 9 comprises an area 16, which projects outwards in radial direction. In the illustrated embodiment, said area is formed in that, on its outer side, the rim 9 comprises a circumferential groove, which extends in the circumferential direction. The area 16, which projects outwards, is thereby arranged on the end of the container body 1, which faces the container closure 2. The skirt 13 comprises an area 17, which projects inwards in the radial direction. In the closed position, said area locks in place with the area 16, which projects outwards. The area 17, which projects inwards, comprises a peak 18. On a first side, which is located closer to the base 12, a first surface 19 follows said peak. On a second side, which is located further away from the base 12, a second surface 20 follows the peak 18. As illustrated, the first and the second surface are inclined in opposite directions relative to the longitudinal container axis 7. In the illustrated exemplary embodiment, the angle of inclination between the first surface 19 and the longitudinal container axis 7 is between 175° and 140°, preferably between 170° and 160°. The angle of inclination between the second surface 20 and the longitudinal container axis is between 5° and 50°, preferably between 10° and 30°. As can be gathered in particular from FIG. 2*b*, the area 17, which projects inwards is substantially triangular-shaped in cross section. The first surface 19 and the second surface 20 are thereby in each case embodied in a cone segment-shaped manner. The peak 18 is formed by a radius-shaped area, which connects the first and the second surface 19, 20.

The area 16, which projects outwards, does not only serve to lock, but simultaneously provides for a seal. For this purpose, the container closure 2 comprises a first sealing segment 30. The latter is arranged on the inner side of the skirt 13 and rests against the outer side of the rim 9 in the closed position, so as form a first seal. The seal is thereby created in particular when the first surface 19 rests against the rim 9. For a better sealing, the rim 9 comprises a cone segment-shaped sealing surface 21. Said sealing surface is formed by the outer contour of the area 16, which projects outwards.

The container comprises a second seal, which is attained by means of a second sealing segment 22. The second sealing segment 22 is arranged on the base. The second sealing segment 22 is thereby located on the side of the base 12, which faces the container body 1. The second sealing segment 22 is arranged such that it rests against the front surface 23 of the rim 9 in the closed position of the container closure 2. It is further shown in the figures that the container comprises no sealing element, which projects into the container opening 8 and lies at the inner side of the rim 9. As a result, the container can be filled along its entire height.

The second sealing section 22 is thereby arranged in a depression. In the illustrated exemplary embodiment, the base 12 comprises a first groove 25 towards the one side of the second sealing segment 22 and a second groove 25' on the other side. The grooves 25, 25' are in each case circumferential. The peak 24 thereby does not project beyond a plane, which is formed by the inner side of the base 12. It can be gathered in particular from FIG. 2*d* that a first boundary surface 26 is arranged on the peak 24 on a first side and a second boundary surface 26' is arranged on a second side. The first and second boundary surfaces 26, 26' are inclined relative to the longitudinal container axis 7. The angle of inclination between first boundary surface 26 and the longitudinal container axis 7 is between 10° and 60°, preferably between 30° and 50°. The angle of inclination between the second boundary surface 26' and the longitudinal container axis 7 is between 10° and 60°, preferably between 30° and 50°. The second sealing segment 22 is substantially triangular-shaped in cross section.

To attain a reliable sealing, the first sealing segment 30 rests against the rim 9 under pretension in that, in the closed position, the skirt 13 is deformed elastically outwards in radial direction because it rests against the rim 9. The outwards elastic deformation path in radial direction is thereby between 0.25% and 2% of the inner diameter of the skirt 13. A deformation between 0.5% and 1% of the inner diameter of the skirt is thereby preferred.

The skirt 13 and the base 12 are furthermore embodied such that the second sealing segment 22 is pretensioned against the front surface 23 by means of the deformation of the skirt 13 in the closed position. An outwards deformation of the skirt 13 leads towards a movement of the second sealing segment 22 relative to the front surface 23.

In the illustrated exemplary embodiment, the front surface 23 extends vertically to the longitudinal container axis 7. The front surface 23 is thereby flat. Alternatively, the front surface can also be arranged on an incline to the longitudinal container axis 7.

The outer side of the container body 1 comprises a segment 27 below the rim 9, which faces outwards from the wall. Said segment is circumferential. The hinge 10 is arranged on the segment 27.

The container comprising the container body 1 and the container closure 2 is embodied as a one-piece injection molded part. Accordingly, the entire container can be produced cohesively in an injection mold. It is thus not necessary to assemble a container closure to the container body retroactively. Instead, it is a one-piece injection molded part. In the case of the illustrated container, the base 12 of the container closure 2 and the container body 1 can be injection-molded from the same plastic material. In the case of the illustrated exemplary embodiment, the first sealing segment 30 and the second sealing segment 22 are furthermore also made from the same plastic material as the base of the container closure.

Figure 3B:
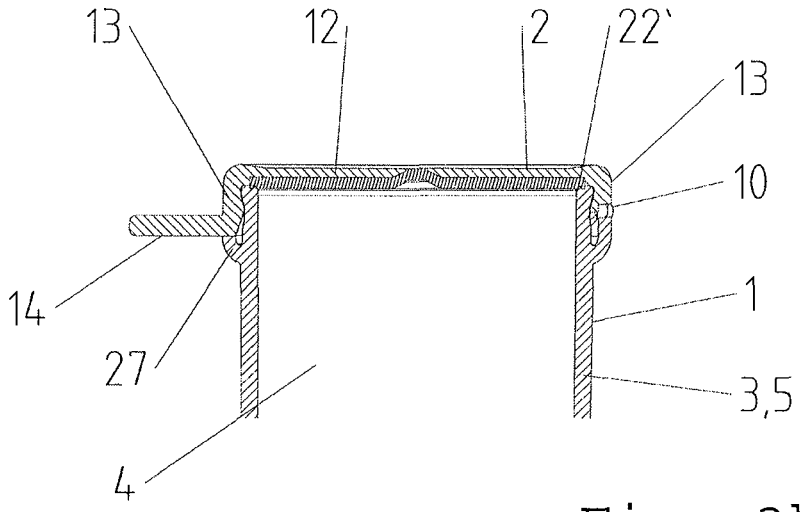
FIG. 3*b* shows a partial cross section through the upper part of the container from FIG. 3*a*.
Figure 3A:
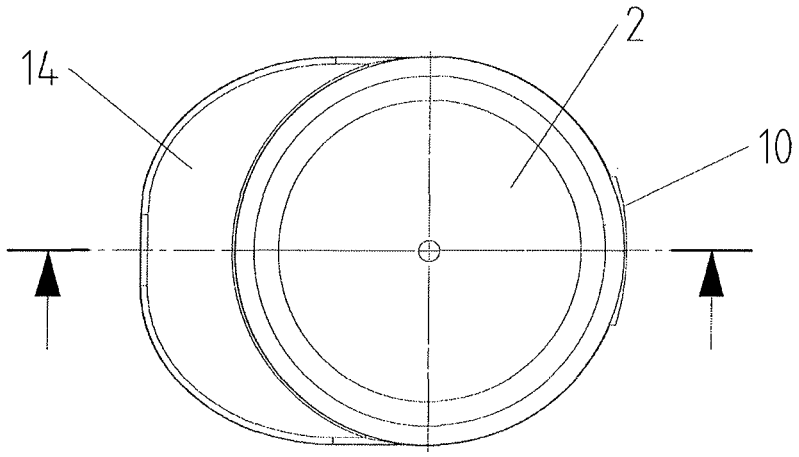
FIG. 3*a* shows a top view onto a container according to the invention according to a further embodiment comprising the container closure in the closed position.

FIGS. 3*a* and 3*b* show a further embodiment. This embodiment corresponds largely to the embodiment illustrated in FIGS. 1*a* to 2*f*. Parts of the same function are provided with the same reference numerals. Reference is made to the corresponding description relating to FIGS. 1*a* to 2*f*, which applies for FIGS. 3*a* and 3*b* in this respect.

Contrary to the preceding figures, however, the second sealing segment 22' is not made from the same plastic material as the base 12. FIG. 3*b* shows well that a different material, which forms the second sealing segment 22', is arranged on the inner side of the base 12. Such a container can be made, for example, in a two component injection molding process.

In the illustrated example, the second sealing segment 22' extends across the entire inner side of the base 12 in a layer manner.

While this invention has been described with reference to preferred embodiments thereof, it is to be understood that variations and modifications can be affected within the spirit and scope of the invention as described herein and as described in the appended claims.

What is claimed is:

1. A container comprising a container body, which comprises a container opening and a container closure for the container opening, wherein the container body and the container closure are embodied as a one-piece injection molded part comprising a hinge, which movably connects the container closure to the container body, wherein the container body comprises a container wall, which forms a container space, wherein the container opening is surrounded by a rim with an outer side, an inner side, and an upward facing flat front surface, wherein the container closure is designed as a snap on closure and can be moved between an open position and a closed position, wherein the container closure comprises a base, at which a skirt is arranged, wherein the container closure comprises a first sealing segment and a second sealing segment, wherein the first sealing segment is arranged on an inner side of the skirt and the second sealing segment is arranged on the base, wherein, in the closed position, the first sealing segment rests against the outer side of the rim so as to form a first contact seal in the closed position, the second sealing segment rests against the front surface of the rim so as to form a second contact seal, wherein the base comprises a first groove with a concave curvature toward the one side of the second sealing segment and a second groove with a concave curvature towards another side of the second sealing segment, wherein the second sealing segment is a peak with a triangular-shaped cross-section and wherein the peak terminates in a radius that rests against the front surface of the rim, and wherein the peak of the second sealing segment terminates at a plane that is formed by an inner side of the base.

2. The container according to claim 1, wherein the skirt additionally comprises an area, which projects inwards in radial direction and the rim additionally comprises an area, which projects outwards in radial direction and that, in the closed position, the area of the skirt, which projects inwards, locks in place with the area of the rim, which projects outwards so as to fix the container closure in the closed position.

3. The container according to claim 2, wherein the first sealing segment and the area, which projects outwards, are embodied such that, in the closed position, the container closure is pulled towards the container body.

4. The container according to claim 2, wherein the area, which projects inwards, comprises a peak, that a first surface is connected to the peak on a first side, which is located closer to the base, and that a second surface is connected to the peak on a second side, which is located further away from the base, and that the first and the second surfaces are arranged so as to be inclined relative to a longitudinal container axis of the container body.

5. The container according to claim 4, wherein the first surface comprises a cone segment-shaped area and/or the second surface comprises a cone segment-shaped area.

6. The container according to claim 4, wherein the peak is formed by a radius-shaped area, which connects the first and the second surface.

7. The container according to claim 1, wherein the rim comprises a cone segment-shaped sealing surface, against which the first sealing segment rests in the closed position.

8. The container according to claim 1, wherein the inner side of the rim is free of any seal between the container closure and the container body.

9. The container according of claim 1, wherein the base of the container closure and the container body are injection molded from the same plastic material.

10. The container according to claim 1, wherein the skirt comprises a first skirt height, that the skirt comprises a recess in the area of the hinge and that the skirt comprises a second lower height in the area of the recess.

11. The container according to claim 1, wherein the second sealing segment is arranged in a depression and wherein the peak of the second sealing segment does not project beyond a plane, which is formed by the inner side of the base.

12. The container according to claim 11, wherein the base comprises, on its inner side, a first groove towards the one side of the second sealing segment and a second groove towards another side of the first sealing segment.

13. The container according to claim 11, wherein a first boundary surface is connected to a first side of the peak of the second sealing segment and that a second boundary surface is connected to a second side of the peak and that the first and the second boundary surfaces are arranged so as to be inclined at an angle relative to a longitudinal container axis of the container body.

14. The container according to claim 1, wherein the first sealing segment rests against the rim under pretension such that, in the closed position, the skirt is deformed elastically outwards in radial direction by resting against the rim.

15. The container according to claim 14, wherein the skirt and the base are embodied such that the second sealing segment is pretensioned against the front surface by means of the deformation of the skirt in the closed position.

16. The container according to claim 1, wherein the first sealing segment and the second sealing segment comprise the same plastic material as the base of the container closure.

17. The container according to claim 1, wherein the first sealing segment and the second sealing segment comprise a different material than the base of the container closure.

* * * * *